US007549366B2

(12) United States Patent
Park et al.

(10) Patent No.: US 7,549,366 B2
(45) Date of Patent: Jun. 23, 2009

(54) HARD ARMOR COMPOSITE

(76) Inventors: Andrew D. Park, 2851 E. Brigstock Rd., Midlothian, VA (US) 23113; Dave Park, 21102 Woodglen Ct., Walnut, CA (US) 91789; Alexander J. Park, 2851 E. Brigstock Rd., Midlothian, VA (US) 23113; William J. Perciballi, 910 E. Mountain Sky Ave., Phoenix, AZ (US) 85048

( * ) Notice: Subject to any disclaimer, the term of this patent is extended or adjusted under 35 U.S.C. 154(b) by 0 days.

(21) Appl. No.: 11/259,878

(22) Filed: Oct. 27, 2005

(65) Prior Publication Data

US 2008/0006145 A1 Jan. 10, 2008

Related U.S. Application Data

(63) Continuation of application No. 10/664,233, filed on Sep. 17, 2003, now abandoned.

(51) Int. Cl.
*F41H 5/02* (2006.01)

(52) U.S. Cl. ..... 89/36.02; 89/36.05; 89/36.07; 428/301.1

(58) Field of Classification Search ..... 89/36.01, 89/36.02, 36.05, 36.07, 36.09; 428/297.4, 428/300.7, 301.1
See application file for complete search history.

(56) References Cited

U.S. PATENT DOCUMENTS

| | | | |
|---|---|---|---|
| 5,635,288 | A | 6/1997 | Park |
| 6,408,733 | B1 | 6/2002 | Perciballi |
| 6,562,435 | B1 | 5/2003 | Brillhart, III et al. |

OTHER PUBLICATIONS

Cunniff, Philip M. and Auerbach, Margaret A.; High Performance "M5" Fiber For Ballisic/Structural Composites, Entire Article, Published Prior to Sep. 17, 2003.

*Primary Examiner*—J. Woodrow Eldred
(74) *Attorney, Agent, or Firm*—Schwartz Law Firm, P.C.

(57) ABSTRACT

A hard armor composite includes a rigid facing and a ballistic fabric backing. The fabric backing is carried by the facing, and includes an array of bundled high-performance fibers. The fibers have a tensile strength greater than 7 grams per denier and a denier per filament ratio of less than 5.4.

14 Claims, 1 Drawing Sheet

HARD ARMOR COMPOSITE

TECHNICAL FIELD AND BACKGROUND OF THE INVENTION

This invention relates to a hard armor composite, and more particularly to an improved small arms protection insert (SAPI) applicable for protecting against multiple small arms bullets and projectiles. In a preferred embodiment, the invention incorporates a rigid ceramic plate and a ballistic fabric backing.

Ceramic armor is typically used for body armor and for the outer coverings of different types of vehicles, such as various types of land vehicles, ships, and aircraft. Typically, ceramic tiles are adhesively secured to a substrate then encapsulated in an outer cover. The armor system is then attached to a vehicle by a variety of means or merely placed in a fabric pocket, as in the case of body armor. An inherent problem in the prior art is that ceramic armor is configured for a fixed level of protection against a single ballistic threat.

The current SAPI incorporates ceramic and an extended chain polyethylene fiber base material known in the industry as "Spectra Unidirectional Cross Plied". This material contains fibers produced by Honeywell International, Inc., and distributed under the brand Spectra Shield® PCR and Spectra Shield® Plus PCR. The current SAPI has been accepted for application by the United States military. However, due to limited production and sources of Spectra Shield® PCR and Spectra Shield® Plus PCR, a need exists for an alternative acceptable ballistic fabric construction which can be readily obtained from multiple sources.

A further need exists for a reduced-weight fabric construction which offers at least comparable and preferably increased ballistic performance. Military specifications call for a SAPI which meets predetermined maximum weight and performance criteria. The ballistic fabric used in the current SAPI has a denier per filament (dpf) ratio of 5.4—denier being defined as a weight measurement in grams per 9000 meter of fiber length; and denier per filament (dpf) defined as denier divided by the number of filaments in a fiber bundle. For an example, Spectra Shield® PCR comprises a nominal 1300 denier fiber with 240 filaments (or, 5.4 dpf. The present invention uses a lower dpf fiber which meets or exceeds the required ballistic performance criteria. The reduced fiber weight enables use of a heavier, less costly ceramic in a SAPI which further satisfies the required maximum weight criteria.

SUMMARY OF THE INVENTION

Therefore, it is an object of the invention to provide a hard armor composite which incorporates a fabric backing including high performance, low denier-per-filament (dpf) fibers.

It is another object of the invention to provide a hard armor composite which offers substantial ballistic performance and is relatively lightweight.

It is another object of the invention to provide a hard armor composite which enables use of a less costly and heavier ceramic material without sacrificing ballistic performance.

It is another object of the invention to provide a hard armor composite which provides protection against multiple types of ballistic projectiles including NATO 7.62×51 mm—80 Ball, Soviet 7.62 mm×54R Ball Type LPS, and U.S. 5.56 mm×M855 Ball.

It is another object of the invention to provide a hard armor composite which may be used alone or as a supplementary armor system to provide increased protection from ballistic projectiles.

It is another object of the invention to provide a small arms protection insert (SAPI) applicable for being worn by military and law enforcement personnel.

It is another object of the invention to provide a hard armor composite which, when placed in a body armor vest pocket, provides ballistic protection from 5.56 mm and 7.62 rounds.

It is another object of the invention to provide alternate, lighter, new and useful means of protecting against ballistic projectiles attack.

It is another object of the invention to provide a new and useful means of arranging ceramic tile armor elements carried on a ballistic fabric backing.

It is another object of the invention to provide a new and useful means of arranging a composite armor backing in conjunction with a ceramic facing.

These and other objects of the present invention are achieved in the preferred embodiments disclosed below by providing a hard armor composite including a rigid facing and a ballistic fabric backing. The fabric backing is carried by the facing, and includes an array of bundled high-performance fibers. The fibers have a tensile strength greater than 7 grams per denier and a denier per filament ratio of less than 5.4.

The term "carried by" means that the fabric backing is bonded or otherwise secured, either directly or indirectly, to the rigid facing.

According to another preferred embodiment of the invention, the fabric backing includes a plurality of overlying fabric layers. The fabric layers may be woven, non-woven, partially non-woven, or knitted. Alternatively, the layers may comprise unidirectional tape which is cross-plied in any angle, or three-dimensional woven or knitted fabrics.

According to another preferred embodiment of the invention, the fabric layers are laminated under heat and pressure to form a unitary ballistic structure.

According to another preferred embodiment of the invention, means are provided for adhering the fabric backing to the facing.

Preferably, the means for adhering is an adhesive selected from the group including a thermoplastic polymer resin matrix and a thermosetting polymer resin matrix.

According to another preferred embodiment of the invention, the means for adhering is a polymer film.

According to another preferred embodiment of the invention, the means for adhering is an adhesive selected from the group including an epoxy adhesive, a polysulfide adhesive, a polyurethane adhesive, a phenolic adhesive, a polyester adhesive, a polyvinyl butyral adhesive, a polyolefin adhesive, and a vinyl ester adhesive.

According to another preferred embodiment of the invention, the facing is constructed of a material selected from the group including ceramic, steel, glass, aluminum, titanium, and graphite.

Preferably, the high-performance fibers are selected from the group including aramid, ultra-high molecular weight polyethylene (UHMWPE), poly{p-phenylene-2,6-benzobisoxazole} (PBO), and poly{diimidazo pyridinylene (dihydroxy) phenylene} (M5).

Preferably, the high-performance fibers comprise one or a combination of the following commercial synthetic fibers: Twaron®, manufactured and distributed by Teijin Twaron® in Conyers, Ga.; Spectra Shield® PCR, manufactured and distributed by Honeywell International, Inc. of Colonial Heights, Va.; PBO Zylone, manufactured and distributed by Toyobo, Japan; and M5.

Alternatively, the fabric backing may comprise multiple layers including one or a combination of Dyneema® UD75 HB2 unidirectional cross-plied material, manufactured and distributed by DSM of Greenville, N.C. and DSM of the Netherlands; and T-Flex™ unidirectional cross-plied material, manufactured and marketed by PTI Armor Systems of Glendora, Calif.

According to another preferred embodiment of the invention, the rigid facing includes a generally flat, continuous monolithic plate. The plate may also have a slight single, double, or compound curvature.

Preferably, the rigid facing and fabric backing have a combined thickness of less than 0.900-inches.

Preferably, the rigid facing and fabric backing have a combined weight of less than 5.1 pounds per square foot.

According to another preferred embodiment of the invention, the rigid facing is constructed of a ceramic material selected from the group including boron carbide, silicon carbide, titanium diboride, aluminum nitride, silicon nitride, sintered silicon carbide, sintered silicon nitride, and aluminum oxide.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
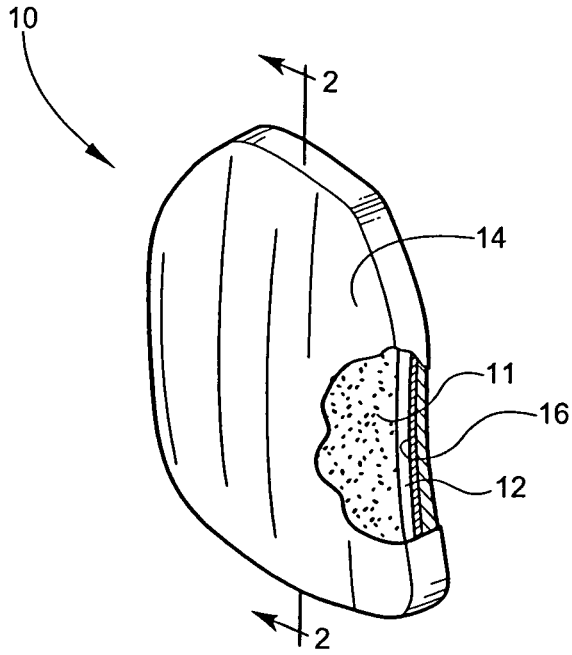
FIG. 1 is a perspective view of a hard armor composite according to one preferred embodiment of the present invention, and showing a portion of the outer cover torn away to expose the interior elements.

Referring now specifically to the drawings, a hard armor composite according to the present invention is illustrated in FIG. 1, and shown generally at reference numeral 10. In one application, the composite 10 is a small arms protection insert (SAPI) designed to protect against multiple small arms bullets and projectiles. The composite 10 is constructed according to United States military specifications, CO/PD 00-03D dated Jan. 13, 2003, in sizes X-small, small, medium, large, and X-large ranging in weight from 2.85 to 5.35 pounds. All SAPI sizes have a uniform nominal areal density of 5.1 pounds per square foot or less. The dimensional measurements are indicated in Drawing Nos. 2-6-265, 2-6-266, 2-6-267, 2-6-268, and 2-6-269 of CO/PD 00-03D. The entire subject matter of CO/PD 00-03D, including text, drawings, tables, and charts, is incorporated herein by reference.

Figure 2:
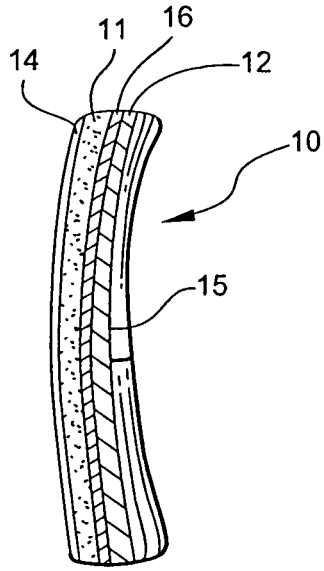
FIG. 2 is a cross-sectional view of the hard armor composite taken substantially along line 2-2 of FIG. 1.

As shown in FIGS. 1 and 2, the hard armor composite (SAPI) 10 comprises a ceramic plate 11 and ballistic fabric backing 12 encased in an outer cover 14. The cover 14 may be formed of a single knit material, such as nylon fabric, or may be a rubberized coating formed by dipping, or may be a combination of fabric, rigid plastic, and foam or honeycomb structure that protects the ceramic from wear-and-tear, and which contains ceramic particles on impact as appropriate. Preferably, the cover 14 includes a bake panel 15 that either partially or completely covers the rear surface of the composite 10.

The ceramic plate 11 is a rigid facing defining a first level of hard armor protection in the composite SAPI. The ceramic plate 11 may include a number of individual elements, such as ceramic tiles, or may be a singular (monolithic) structure that is either flat or molded to a desired shape. The plate 11 is made of any suitable ceramic material, such as boron carbide, silicon carbide, high purity aluminum oxide, titanium diboride, aluminum nitride or silicon nitride or sintered silicon carbide and sintered silicon nitride ceramics. Alternatively, a ceramic matrix composite or metal matrix composite containing any of above-mentioned ceramics could be used. Although ceramic thickness may be varied to suit the specific SAPI need, the preferred ceramic arrangement ranges from 0.080-inches to 0.40-inches in thickness.

The fabric backing 12 is bonded or otherwise secured, either directly or indirectly, to the ceramic plate 11, and provides a second level of protection against ballistic penetration. Preferably, the ceramic plate 11 and fabric backing 12 are joined together by a layer 16 of adhesive, such as a thermoplastic or thermoset polymer, an elastomeric resin matrix, or a film, such as epoxy, polyurethane, polysulfide, polyolefin, phenolic, polyester, vinyl ester, polyvinyl butyral.

The backing 12 is constructed of bundled, high-performance, low denier per filament (dpf) fibers comprising any one or a combination of aramid, extended chain ultra-high molecular weight polyethylene (UHMWPE), poly{p-phenylene-2,6-benzobisoxazole} (PBO), and poly{diimidazo pyridinylene(dihydroxy)phenylene} (M5). Each of these fibers has a tensile strength greater than 7 grams per denier. Suitable commercial fibers include: Twaron® micro-denier fiber of less than nominal 1000 denier and 1.5 dpf or lower; Spectra Shield® PCR fiber of less than nominal 1300 denier and less than 5.4 dpf; Dyneema® UD (unidirectional) fiber of nominal 1600 denier and 2.0 dpf or lower; PBO Zylon® fiber of nominal 1000 or 500 denier and 1.5 dpf or lower; and aramid Kevlar® fiber of nominal 1500 denier and 1.5 dpf. The fibers are preferably HM (high modulus) grade with low moisture content. The preferred embodiment utilizes high-performance fibers having less than 5.4 dpf, and more preferably, less than 2.0 dpf, and most preferably, less than 1.5 dpf.

The fibers are incorporated in multiple, stacked layers comprising knit, woven, or non-woven fabrics, non-woven or woven unidirectional tapes, felts, and three-dimensional structures. The stacked layers are laminated under heat and pressure together with any of a variety of polymer compounds to create a dense, rigid, unitary ballistic structure ranging in thickness from 0.130-inches to 0.350-inches. Lamination occurs via autoclave, press molding, a resin transfer mold, and/or an oven with vacuum pressure. According to one embodiment, the fabric backing 12 is further encased in a polymer matrix or film, specifically, a thermoplastic or thermoset matrix. The matrix may include any suitable polymer resin or film, such as phenolic, polysulfide, phenolic, polyvinyl butyral rubber blends, polyester, vinyl ester, polyurethane, and polyolefin resins or combinations thereof. When using a polymer resin matrix, the preferred resin content ranges from fifteen to twenty-four percent by weight.

Figure 3:
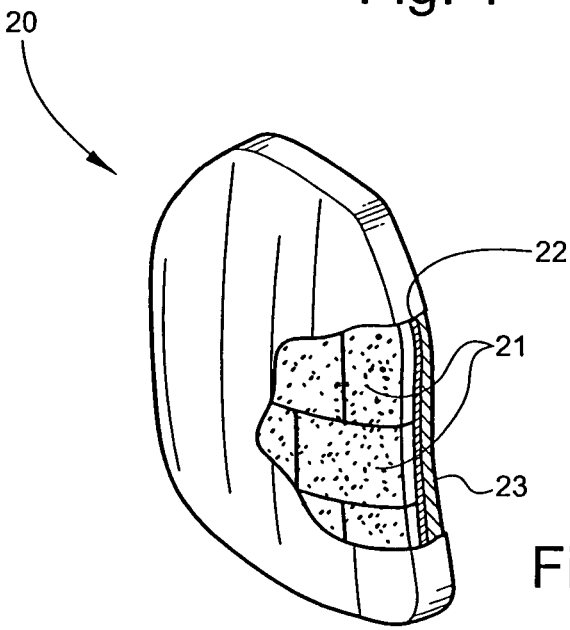
FIG. 3 is a perspective view of a hard armor composite according to a second preferred embodiment of the present invention, and showing a portion of the outer cover torn away.

In an alternate embodiment shown in FIG. 3, the hard armor composite (SAPI) 20 includes an arrangement of individual ceramic tiles 21 defining a rigid facing, an adhesive layer 22, and a ballistic fabric backing 23. The ceramic tiles 21 can be square or otherwise shaped to suit the dimensional needs of a particular application. The fabric backing 23 incorporates high-performance, low dpf fibers, and is constructed in a manner identical to that described above. The adhesive layer 22 joins the tile elements and fabric backing together to form a unitary ballistic composite.

In each of the above embodiments, the hard armor composite 10, 20 forms a SAPI which meets or exceeds the ballistic performance criteria outlined in CO/PD 00-03D. Specifically, Section 3.9.3 of CO/PD 00-03D states that the SAPI when inserted in a nylon cordura carrier will be capable of defeating three impacts (2 impacts at 0-degrees obliquity and 1 impact at 30-degrees obliquity) from each of the following threats:

a. NATO 7.62×51 mm—80 Ball at 2,750+50 feet per second.

b. Soviet 7.62 mm×54R Ball Type LPS at 2,300+50 feet per second.

c. U.S. 5.56 mm M855 Ball at 3,250+50 feet per second.

The use of a ballistic fabric backing incorporating high-performance, low dpf fibers not only reduces the overall weight of the composite, but offers increased ballistic performance as compared relatively high dpf fibers. The current commercial SAPI incorporates high-performance fibers with a 5.4 dpf. The V50 ballistic performance of fabric constructed of this fiber is compared in the table below with fabric of lower dpf fibers.

V50 data with 9 mm 124 grams per Mil-STD 662.

UHMWPE Fiber Based Fabric:

| | Dpf | V50(fps) | ADT(Areal density) psf |
|---|---|---|---|
| Spectra Shield ® | 5.4 | 1590 | .91 |
| Dyneema ® UD | 2.0 | 1679 | .91 |

Aramid Fiber Based Fabric:

| | | | |
|---|---|---|---|
| Kevlar ® 29 | 1.5 | 1290 | .80 |
| Kevlar ® 29 | 1.5 | 1400 | 1.0 |
| Twaron ® | 1.0 | 1483 | .87 |
| Twaron ® | 1.0 | 1562 | .91 |
| T-Flex ™ | 1.0 | 1520 | .80 |
| T-Flex ™ | 1.0 | 1590 | .93 |

A hard armor composite is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

We claim:

1. A hard armor composite, comprising:

(a) a rigid facing;

(b) a lightweight ballistic fabric backing carried by said facing, and comprising an array of bundled high-performance fibers, said fibers having a tensile strength greater than 7 grams per denier and a denier per filament ratio of less than 5.4, and said fabric backing comprising a plurality of overlying fabric layers, and said fabric backing and said rigid facing having a combined thickness of less than 0.900-inches, and wherein a thickness of said fabric backing comprises greater than 60% of the combined thickness of said fabric backing and said rigid facing;

(c) said hard armor composite having an areal density not greater than 5.1 psf, and increased ballistic resistance capable of defeating impacts from threats selected from a group consisting of:

i. NATO 7.62×51 mm—80 Ball at 2,750+50 feet per second;

ii. Soviet 7.62 mm×54R Ball Type LPS at 2,300+50 feet per second; and;

iii. U.S. 5.56 mm M855 Ball at 3,250+50 feet per second; and (d) means for adhering said fabric backing to said facing, said means for adhering being selected from a group consisting of a polymer film, an epoxy adhesive, a polysulfide adhesive, a polyurethane adhesive, a phenolic adhesive, a polyester adhesive, a polyvinyl butyral adhesive, a polyolefin adhesive, and a vinyl ester adhesive.

2. A hard armor composite according to claim 1, wherein said fabric layers are laminated under heat and pressure to form a unitary ballistic structure.

3. A hard armor composite according to claim 1, wherein said facing is constructed of a material selected from the group consisting of ceramic, steel, glass, aluminum, titanium, and graphite.

4. A hard armor composite according to claim 1, wherein said high-performance fibers are selected from the group consisting of aramid, ultra-high molecular weight polyethylene (UHMWPE), poly{p-phenylene-2,6-benzobisoxazole} (PBO), and poly{diimidazo pyridinylene(dihydroxy)phenylene} (M5).

5. A hard armor composite according to claim 1, wherein said rigid facing comprising a generally flat, continuous monolithic plate.

6. A hard armor composite, comprising:

(a) a rigid facing;

(b) a lightweight ballistic fabric backing carried by said facing, and comprising an array of bundled high-performance fibers, said fibers having a tensile strength greater than 7 grams per denier and a denier per filament ratio of less than 5.4, and said fabric backing comprising a plurality of overlying fabric layers, and said fabric backing and said rigid facing having a combined thickness of less than 0.900-inches, and wherein a thickness of said fabric backing comprises greater than 60% of the combined thickness of said fabric backing and said rigid facing;

(c) said hard armor composite having an areal density not greater than 5.1 psf, and increased ballistic resistance capable of defeating impacts from threats selected from a group consisting of:

i. NATO 7.62×51 mm—80 Ball at 2,750+50 feet per second;

ii. Soviet 7.62 mm×54R Ball Type LPS at 2,300+50 feet per second; and;

iii. U.S. 5.56 mm M855 Ball at 3,250+50 feet per second.

7. A hard armor composite, comprising:

(a) a ceramic facing; and (b) a lightweight ballistic fabric backing carried by said facing, and comprising an array of bundled high-performance fibers, said fibers having a tensile strength greater than 7 grams per denier and a denier per filament ratio of no more than 2.0, and said fabric backing comprising a plurality of overlying fabric layers, and said fabric backing and said ceramic facing having a combined thickness of less than 0.900-inches, and wherein a thickness of said fabric backing comprises greater than 60% of the combined thickness of said fabric backing and said rigid facing; and (c) said hard armor composite having an areal density not greater than 5.1 psf, and increased ballistic resistance capable of defeating impacts from threats selected from a group consisting of:

i. NATO 7.62×51 mm—80 Ball at 2,750+50 feet per second;

ii. Soviet 7.62 mm×54R Ball Type LPS at 2,300+50 feet per second; and;

iii. U.S. 5.56 mm M855 Ball at 3,250+50 feet per second.

8. A hard armor composite according to claim 7, wherein said ceramic facing comprises a material selected from the group consisting of boron carbide, silicon carbide, titanium diboride, aluminum nitride, silicon nitride, sintered silicon carbide, sintered silicon nitride, and aluminum oxide.

9. A hard armor composite according to claim 7, and comprising means for adhering said fabric backing to said ceramic facing.

10. A hard armor composite according to claim 9, wherein said means for adhering comprises a polymer film.

11. A hard armor composite according to claim 9, wherein said means for adhering comprises an adhesive selected from the group consisting of an epoxy adhesive, a polysulfide adhesive, a polyurethane adhesive, a phenolic adhesive, a polyester adhesive, a polyvinyl butyral adhesive, a polyolefin adhesive, and a vinyl ester adhesive.

12. A hard armor composite according to claim 7, wherein said ceramic facing comprises a generally flat, continuous monolithic plate.

13. A hard armor composite according to claim 7, wherein said high-performance fibers are selected from the group consisting of aramid, ultra-high molecular weight polyethylene (UHMWPE), poly{p-phenylene-2,6-benzobisoxazole} (PBO), and poly{diimidazo pyridinylene (dihydroxy) phenylene} (M5).

14. A hard armor composite according to claim 7, wherein said fabric layers are laminated under heat and pressure to form a unitary ballistic structure.

* * * * *